US006126543A

United States Patent [19]

Friedman

[11] Patent Number: 6,126,543

[45] Date of Patent: Oct. 3, 2000

[54] METHOD FOR WAGERING ON COMBINED POINT SPREADS FROM MULTIPLE CONTESTS

[75] Inventor: Mark E. Friedman, Chicago, Ill.

[73] Assignee: Innovative Gaming Systems LTD, High Falls, N.Y.

[21] Appl. No.: 09/004,546

[22] Filed: Jan. 8, 1998

[51] Int. Cl.[7] ..... A63F 9/22

[52] U.S. Cl. ..... 463/16; 273/139

[58] Field of Search ..... 463/3, 16, 17, 463/18, 19, 20, 25, 26, 27, 40, 41, 42; 273/236, 237, 269, 139

[56] References Cited

U.S. PATENT DOCUMENTS

| | | | |
|---|---|---|---|
| 4,108,361 | 8/1978 | Krause | 235/375 |
| 4,252,321 | 2/1981 | Hopwood | 273/247 |
| 4,292,507 | 9/1981 | Hovorka | 235/90 |
| 5,027,102 | 6/1991 | Sweeny | 340/323 |
| 5,263,723 | 11/1993 | Pearson et al. | 273/439 |
| 5,374,060 | 12/1994 | Goldberg | 273/139 |
| 5,489,096 | 2/1996 | Aron | 273/138 |
| 5,513,850 | 5/1996 | Vancura | 273/274 |
| 5,518,239 | 5/1996 | Johnston | 273/139 |
| 5,573,244 | 11/1996 | Mindes | 463/26 |
| 5,626,341 | 5/1997 | Jones et al. | 273/292 |
| 5,683,090 | 11/1997 | Zeile et al. | 273/269 |
| 5,743,525 | 4/1998 | Haddad | 273/139 |
| 5,769,714 | 6/1998 | Wiener et al. | 463/3 |
| 5,842,921 | 12/1998 | Mindes et al. | 463/16 |
| 5,957,775 | 9/1999 | Cherry | 463/16 |

*Primary Examiner*—Michael O'Neill
*Attorney, Agent, or Firm*—Brown Raysman Millstein Felder & Steiner LLP

[57] ABSTRACT

A method for wagering on multiple sporting events. Each sporting event involves two teams, each team having associated therewith a point spread used in determining whether a wager made on the team is won. The bettor selects a team from each of two or more events upon which to place a wager. The point spreads associated with the selected teams are summed to define a combined point spread wager, and the bettor wagers on the combined point spread. The bettor wins the wager if a sum of point differentials associated with the selected teams as determined from the results of the sporting events covers the combined point spread. Combination bets may also be placed on over/under numbers. Combination betting allows bettors to place an interest on a number of different games while maintaining that interest until all games are completed.

25 Claims, 4 Drawing Sheets

| FAVORITE | LINE | UNDERDOG | OVER/UNDER |
|---|---|---|---|
| DALLAS | -3 | PITTSBURGH | 38 |
| NEW YORK | -9 | MIAMI | 39 |
| NEW ENGLAND | -13 | ATLANTA | 36½ |
| BUFFALO | PICK | DETROIT | 43 |
| CHICAGO | -3½ | NEW ORLEANS | 39½ |
| ARIZONA | -5 | SAN FRANCISCO | 33 |
| BALTIMORE | -6½ | CINCINNATI | 40½ |

FIG. 1

| FAVORITE | LINE | UNDERDOG | LINE |
|---|---|---|---|
| NEW YORK | -½ | NEW JERSEY | EVEN |
| PITTSBURGH | -2 | DETROIT | +1½ |
| BOSTON | -1 | ST. LOUIS | +½ |
| CHICAGO | -1 | DALLAS | +½ |

FIG. 2

| FAVORITE | LINE | UNDERDOG |
|---|---|---|
| DETROIT | -½, -140 | COLORADO |
| ANAHEIM | -1, -125 | EDMONTON |
| TORONTO | EVEN, -115 | TAMPA BAY |
| MONTREAL | -1½, -130 | CAROLINA |

FIG. 3

METHOD FOR WAGERING ON COMBINED POINT SPREADS FROM MULTIPLE CONTESTS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The invention disclosed herein relates generally to sports wagering systems. More particularly, the present invention relates to a method and system for accepting wagers on multiple sporting events by combining the point spreads associated with the teams selected in the events into a combination bet and determining whether the combined point differentials determined from outcomes of the events covers the combination bet.

Betting on sporting events is a popular activity among sports fans and spectators. Aside from the monetary benefits achieved from successful betting, betting increases a spectator's interest in and enjoyment received from watching and keeping track of the events as they progress. This increases interest in and viewership of the sports activity in general.

There are several types of bets which may be placed on sporting events. In one type, a straight bet, a wager is placed on a single event whose outcome is determined by selection of the winning team, a point spread, money odds, another number, or some combination of these elements. The point spread and money line are usually set by a licensed sports booking agency or licensed gambling institution to even out disparities between the teams involved in the game. For example, if a football team from New York is scheduled to compete against a football team from Chicago, and the New York team is considered a better team and is favored to win by 7 points, the point spread for the game is set as 7. In theory, while the New York team is more likely to win than the Chicago team, it is equally likely that it will win by more than 7 points than that it will win by less than 7 points or will lose.

In the example given, a bettor may place a bet on New York to beat or cover the point spread by winning by more than 7 points or on Chicago to beat the point spread by losing by less than 7 points or by winning. If New York beats Chicago by exactly 7 points, this is generally considered a tie or "push," and the money bet on the game is returned. This point spread is typically represented as New York −7 and Chicago +7, or simply "New York −7 Chicago." A sample line containing a set of point spreads for a number of professional football games is shown in FIG. 1.

A game may have two point spreads, one for each team. Thus for example in a hockey match, the point spread for the favored team may be to win by 1 goal (i.e., −1), while the point spread for the underdog team may be +½, meaning that the underdog team can not lose by 1 goal or more. A bet on the favorite is successful if the team wins by more than one goal, and a bet on the underdog is successful if the underdog wins or ties. If the favorite beats the underdog by one goal, a bet on the favorite is a push, while a bet on the underdog loses. FIG. 2 contains a sample line for a professional hockey schedule showing these types of point spreads.

Another type of straight bet is an over/under bet representing the total amount of points the two teams will score in the game. A bettor can bet that the teams will exceed or go over the over/under bet or go under the bet. Ties are usually considered pushes, with money returned. Over/under bets may be combined with money lines. The sample professional football line shown in FIG. 1 also contains over/under bets for each contest.

Odds may be set on the match as an alternative to or in addition to the point spread or over/under bet. These odds, represented in the money line, govern how much a bettor receives for a given wager if successful. For example, in the football game described above, the money line for New York may be −260, meaning that a bettor receives $100 of winnings for every $260 bet, and the money line for Chicago may be +110, meaning that the bettor receives $110 of winnings for every $100 bet. The money lines even the disparity between the teams with odds so that, on the whole, the gambling institution will break even or come out ahead. The difference in payout between the favorite and underdog is typically retained by the gambling institution as a commission for handling the wagers.

A money line may be combined with a point spread, in which case the bettor must cover the point spread in order to win the amount determined by the money line. Professional baseball usually uses only money lines, while professional hockey sometimes combines point spreads and money lines. A sample hockey line containing sample money lines for each game is shown in FIG. 3. As shown in FIG. 3, in a typical line each game has a single point spread and a money line which varies depending upon the team selected. That is, for example, if the bettor bets on Detroit and Detroit covers the point spread, the bettor receives $100 for every $140 bet. If the gambling institution maintains a $15 differential, it pays only $125 for every successful $100 bet on Colorado (the 140 money line −15).

Other types of bets involve betting on a number of teams or games together. In a parlay bet, the bettor makes straight bets on teams in two or more games, by betting based on the point spread or over/under in each game, and must win each of the selected games in order to win the bet. The amount paid for a successful parlay bet depends upon the number of games selected. A typical payout scheme is 1.6/1 for a two game parlay (i.e., a bet of $1 pays $2.60), 6/1 for a three game parlay, 10/1 for a four game parlay, 20/1 for a five game parlay, and higher payouts for additional games included in the parlay. In the case of a push in any game, that game is usually discounted and the parlay reduced to the next lower number of selections.

A teaser bet is similar to a parlay bet, except that the point spread is shifted by a certain number of points in all games included in the bet. The number of points by which the point spread may be shifted typically depends upon the sport involved. In professional football, the point spread may typically be adjusted by 6, 6½, 7, or 10 points, while in professional basketball the point spread may typically be changed by 4, 4½, 5, or 8 points. Using the line shown in FIG. 1 as an example, a bettor can place a three team, 6 point teaser bet on Dallas, New York, and Atlanta, changing the points spreads as follows: from −3 to +3 for Dallas, from −9 to −3 for New York, and from +13 to +19 for Atlanta. The payouts in a teaser are adjusted to account for the bettor's increased odds of winning the bet. For example, whereas a parlay of the three teams in this example would pay 6/1, the three team teaser would pay 8/5.

Aside from the prospect of increased payouts, parlay and teaser bets provide the bettor with the enjoyment of having a stake in the outcomes of several games and contemplating scenarios of results needed to win the bet. This maintains the bettor's interest in all the games included in the bet, and provides for more exciting spectating over simply making a number of unconnected straight bets, in which each bet is simply won or lost on its own.

However, in both the teaser and parlay bets, each of the teams selected by the bettor must cover the point spread in order for the bet to win. If any one team fails to cover the point spread, the bet is lost. If that team loses before other games in the bet are finished or even begin, the bettor's interest in those other games is diminished significantly. Thus, for example, professional football games scheduled for a given weekend are played at different days and times, e.g., games are played on Sunday at 1:00 EST, 4:00 EST and 8:00 EST and on Monday night. If the bettor places a three team parlay or teaser bet on games to be played at 1:00 Sunday, 4:00 Sunday and Monday night, a failure to cover the point spread by the team bet in the first game eliminates the bettor's chance of winning the bet, and thus the bettor has less interest in watching or keeping track of the scores in the later games. Over/under parlay bets have the same disadvantage.

There is thus a need for a wagering method which allows bettors to maintain increased interest in a number of games as with a parlay or teaser bet but which does not resolve a bet until after all games have been completed. The present invention provides such a method.

BRIEF SUMMARY OF THE INVENTION

It is an object of the present invention to solve the problems described above associated with wagering on sporting events.

It is another object of the present invention to provide an entertaining wagering system which retains the bettor's interest in the outcomes of multiple sporting events until completion of all the events.

The above and other objects are achieved by a method for accepting wagers on multiple contests in which bettors are presented with a plurality of contests upon which to wager, each contest having associated therewith at least one number, such as a point spread or over/under line, which determines based upon an outcome of the contest whether a wager made on the contest is won. The method involves allowing the bettor to select two or more of the plurality of the contests upon which to place a wager and computing a first combined number for the selected contests based on the numbers associated with the selected contests. When the outcomes of the selected contests are determined, a second combined number is computed based on the outcomes of the selected contests, and this second combined is compared to the first combined number to determine whether the bettor wins the wager.

In preferred embodiments, the contests are sporting events, the number is a point spread, and the bettor selects teams upon which to wager. The first combined number is calculated by summing the point spreads associated with the selected teams, and the second combined number is the sum of point differentials in the scores, final or partial, of the selected sporting events. In particular, the second combined number is calculated in one preferred embodiment by summing the points scored by the teams not selected in the wager, summing the points scored by the selected teams, and subtracting the latter sum from the former sum. The bet is considered successful if the combined point spread is greater than the combined point differential.

The above and other objects of the present invention are also achieved by a system for wagering on multiple contests comprising means for selecting two or more of a plurality of the contests upon which to place a wager, each contest having associated therewith at least one number which determines based upon an outcome of the contest whether a wager made on the contest is won, means for computing a first combined number for the selected contests based on the numbers associated with the selected contests, means for computing a second combined number based on the outcomes of the selected contests, and means for comparing the first combined number to the second combined number to determine whether the bettor wins the wager.

In some embodiments, the system includes a computer network in which betting lines are input to and stored on a server and transmitted to local or remote terminals such as network terminals, personal computers, or interactive television receivers. Bettors at the terminals can view the lines and select the teams upon which to bet. A program on the server processes the bets and determines which are successful based upon the results of the games.

BRIEF DESCRIPTION OF THE DRAWINGS

The invention is illustrated in the figures of the accompanying drawings which are meant to be exemplary and not limiting, in which like references refer to like or corresponding parts, and in which:

FIGS. 1–3 show sample betting lines for different sports;

DETAILED DESCRIPTION OF THE PREFERRED EMBODIMENTS

Figure 4:
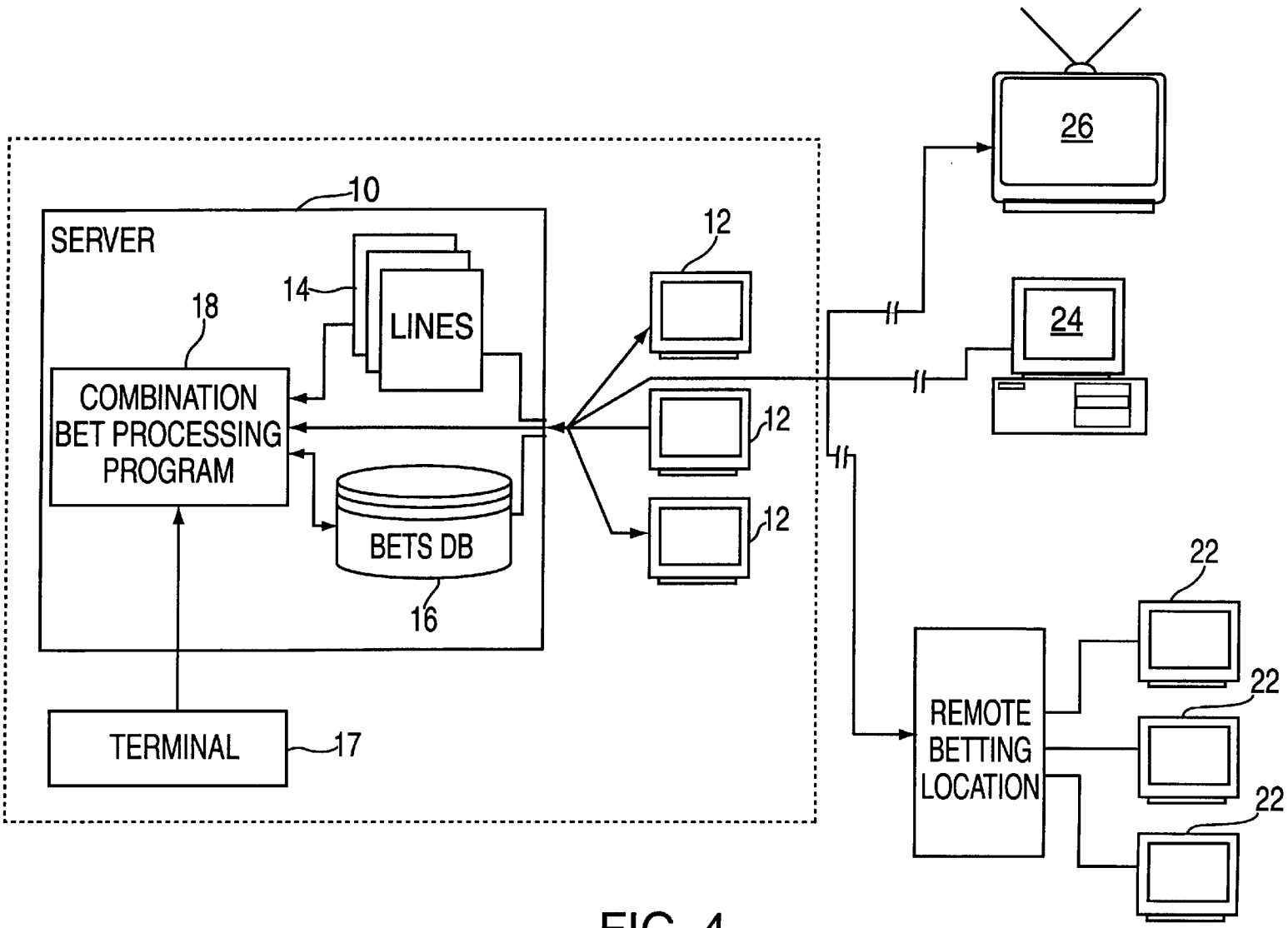
FIG. 4 is a block diagram of a system of one preferred embodiment of the present invention.

Preferred embodiments of the present invention are now described with reference to the lines shown in FIGS. 1–3, the system diagram in FIG. 4, and the flow chart in FIGS. 5A and 5B. In accordance with the invention, a bettor may place a combination bet on multiple games. Using point spreads, the combination bet is formed by selecting a number of teams from different games and summing the respective point spreads. For example, using the line in FIG. 1, a bettor may place a two team combination bet on Dallas and New York. The combination spread is the sum of the point spread for Dallas and the point spread for New York, i.e., −3+−9=−12. The bettor wins the combination bet if Dallas and New York win by a total of 13 points or more combined. Thus for example, if Dallas wins by 2 and New York wins by 12, the bettor wins the combination bet even though Dallas failed to cover the point spread in its game. The bettor can also win the bet even if one of the favorites upon which he bet loses the game. For example, if Dallas loses by 1, the bettor wins the bet if New York wins by 14 or more points, so that the combined point spread total for the two teams is 13 or more points.

Bettors placing a combination bet thus have a stake in all the games in the bet and maintain that interest until all games are completed. In the example given above, if the Dallas/Pittsburgh game is played before the New York/Miami game, and Dallas fails to cover the point spread, the bettor can still win the bet if New York beats Miami by a sufficient number of points to meet the combination point spread. For example, if Dallas loses by 7, the bettor roots for New York to meet the combined point spread by winning by 20. Similarly, if Dallas covers the point spread and more, the bettor still needs New York to perform adequately to cover the combination spread. For example, if Dallas wins by 14, the bettor needs New York to win or not lose by more than 1 point.

As a further illustration, if the bettor places a combination bet on Dallas and Miami, the combination point spread becomes −3++9=+6. The bettor wins the combination bet if Dallas and Miami both win, or lose by a total of no more than 5 points. A loss by Miami by more than 9 points (the point spread against New York) can be offset by a win by Dallas by enough points to cover the combined spread.

Similarly, the bettor can select more than two teams as part of a combination bet. Using the line in FIG. 1, the bettor can select all favorites, all underdogs, or a mix of favorites or underdogs, and the point spreads are summed into a combination point spread. For example, the bettor can bet on Dallas (−3), Atlanta (+13), Buffalo (pick, i.e., point spread=0), and Chicago (−3½). The combination point spread is therefore +6½ (=−3++13+0+−3½). The combined point differential from the results of these four games must have these four teams not losing by more than 6½ points in order to win the combination bet. Although selecting Buffalo vs. Detroit does not change the combined point spread because the line on the game is pick or even, the result of that game will obviously impact upon whether the bettor wins or loses the bet.

In general, a combination bet on n games is won if the following condition is met:

$$\sum_{i=1}^{n} PS_i > \sum_{i=1}^{n} PTNS_i - \sum_{i=1}^{n} PTS_i$$

where $PS_i$ is the point spread associated with the team selected in game i, $PTNS_i$ is the points scored by the team in game i not selected for the wager, and $PTS_i$ is the points scored by the team selected in game i. For example, using the four team combination bet on Dallas, Atlanta, Buffalo, and Chicago set forth above, the bet is won if the combined point spread of +6½ is greater than the sum of the points scored by the teams not selected, i.e., Pittsburgh, New England, Detroit, and New Orleans, less the sum of the points scored by the four teams selected. If the games have the following outcomes—Dallas 28 Pittsburgh 27; New England 21 Atlanta 10; Buffalo 17 Detroit 16; and Chicago 35 New Orleans 31—then the bet is won because, applying the general formula given above, $$+6\tfrac{1}{2} > (27+21+16+31)-(28+10+17+35) = 95-90 = +5.$$

As will be recognized by those of skill in the art, for any n games selected by the bettor, there are $2^n$ possible combination bets which may be placed. In one embodiment of the invention, the payout on a combination point spread bet is no different than the payout on a straight bet. If a straight bet pays 1/1, so will a combination bet. This is because, for any set of teams selected there is an exactly opposite bet which may be placed on the set of competing teams. One and only one of these offsetting bets can be successful, unless they both tie. Thus, excluding ties, half the bets placed on any combination of games are successful and the corresponding opposite half are unsuccessful.

Although the payout may not be greater in a combination bet than a straight bet, use of a combination bet allows bettors to offset unexpected results from one game with more favorable results in other games. In addition, the combination bet allows bettors to maintain an interest in a number of games based only on one bet rather than many, which is particularly important when an institution imposes minimum amounts on each bet.

As an alternative to betting on a combined point spread, a bettor may bet on a combination of over/under bets. The over/under bets are then summed or averaged to produce a combination over/under bet. This combination bet is compared to the summed or average total scores from all games in the bet. Thus, for example, if a bettor selects the games involving Dallas/Pittsburgh, Arizona/San Francisco, and Baltimore/Cincinnati, the combined over/under is, if averaged, (38+33+40½)/3=37.167 (or 111½, if summed). The bettor wins the bet if average or summed total points scored in these games is either over or under, depending upon the bettor's choice, this combined over/under number. As with point spreads, this combination bet maintains the bettor's interest in the outcome of all the games in the bet until their completion.

In the case of the dual point spread games shown in the line in FIG. 2, a combination bet is placed by summing the point spreads associated with the selected teams. For example, if the bettor bets on New Jersey, Detroit, Boston and Chicago, the combined point spread is −½ (=0++1½+−1+−1), and these four teams must produce a total point differential over the opposing teams which is at least one goal. Selecting all the opposing teams produces a different combined point spread, in this case −1½. If the point differential between these two sets of teams is zero or +1 in favor of the second set, neither of these opposing combination bets is successful. This differential may either benefit the booking institution or may result in increased payouts for the combination bets.

Referring now to the line in FIG. 3, a combination bet for games with a point spread and money line involves summing the point spread as before and averaging the money line. When all favorites or all underdogs are selected, the money line is averaged by simply summing the money line for each team and dividing by the number of games in the bet. For example, if the bettor bets on Colorado, Edmonton, Tampa Bay and Carolina, the combined point spread is +3 and the combined money line is +112.5=(+125++110++100++115)/4, applying the $15 money line differential between each favorite and underdog, as explained above. If these four teams produce a point differential which is greater than the point spread, the bettor wins $112.50 for every $100 bet.

If the bettor selects a combination of favorites and underdogs, the combined money line is calculated by first adjusting each money line by stripping off the amount of the line over or under 100, averaging these numbers, and adding or subtracting 100, depending upon the sign of the resulting number. The combined money line can be represented as follows:

$$ML_c = 1/n * \sum_{i=1}^{n} (Ml_i \pm 100) \pm 100$$

where n is the number of games selected, $Ml_i$ is the money line for the $i^{th}$ game, and $ML_C$ is the combined money line. The choice of whether to add or subtract 100 to reach the combined money line depends on whether the sum to that point is positive (add 100) or negative (subtract 100). For example, if the bettor selects, from the line in FIG. 3, Detroit at a money line of −140, Edmonton at +110, Tampa Bay at +100, and Carolina at +115, the money line is −103.75=((−40+10+0+15)/4)−100. If these four teams cover their combined point spread, the payout is $100 for every $103.75 bet.

For baseball or other sports which typically only use a money line without a point spread, a combination money line may be calculated as just described to determine how much a bettor receives for a combination bet. A bettor would select multiple teams in a parlay-type bet, and the calculated combination money line would determine how much the bettor receives if the parlay bet is successful.

Figure 5A:
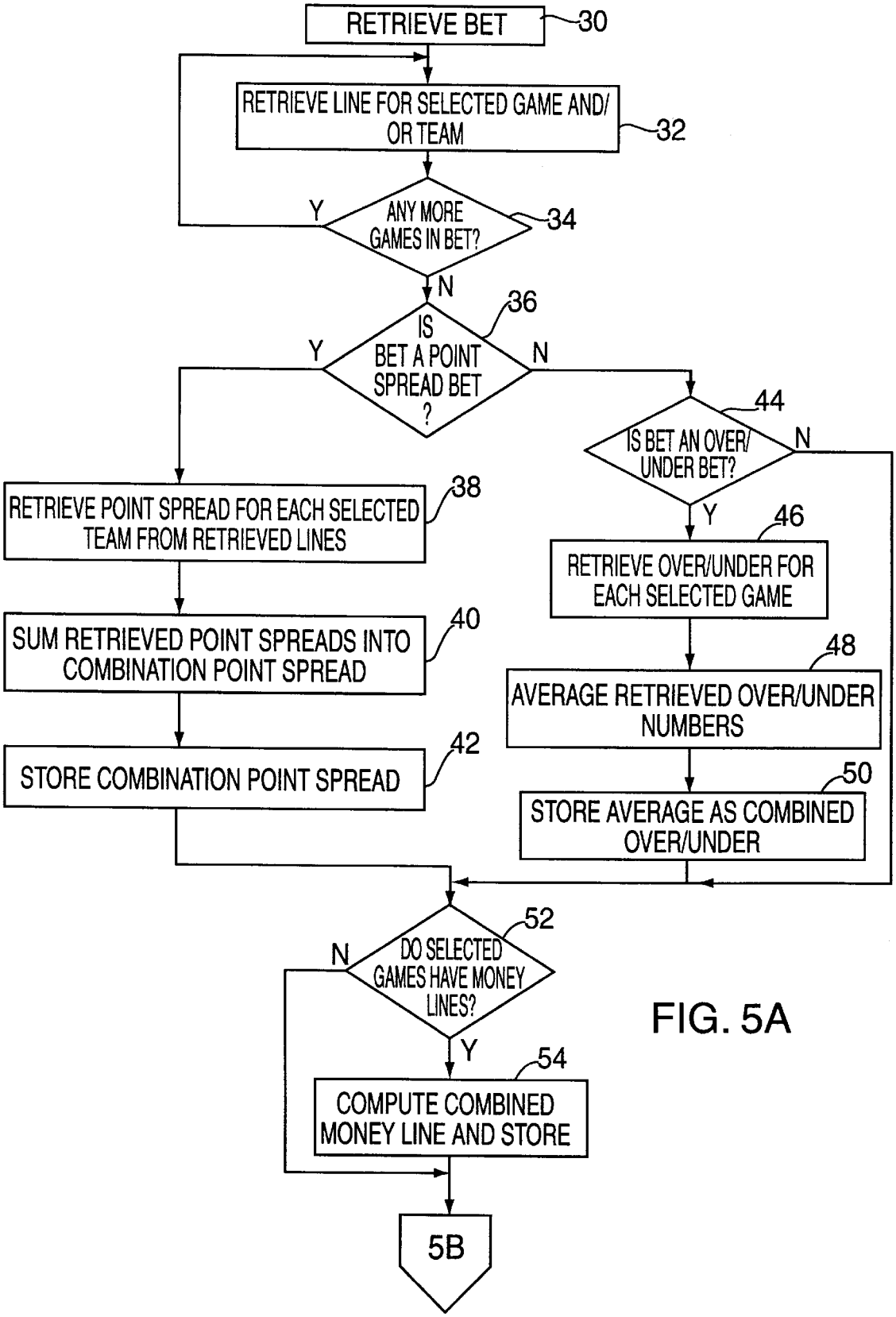
FIGS. 5A and 5B contain a flow chart showing the wagering process in accordance with one preferred embodiment of the present invention.
Figure 5B:
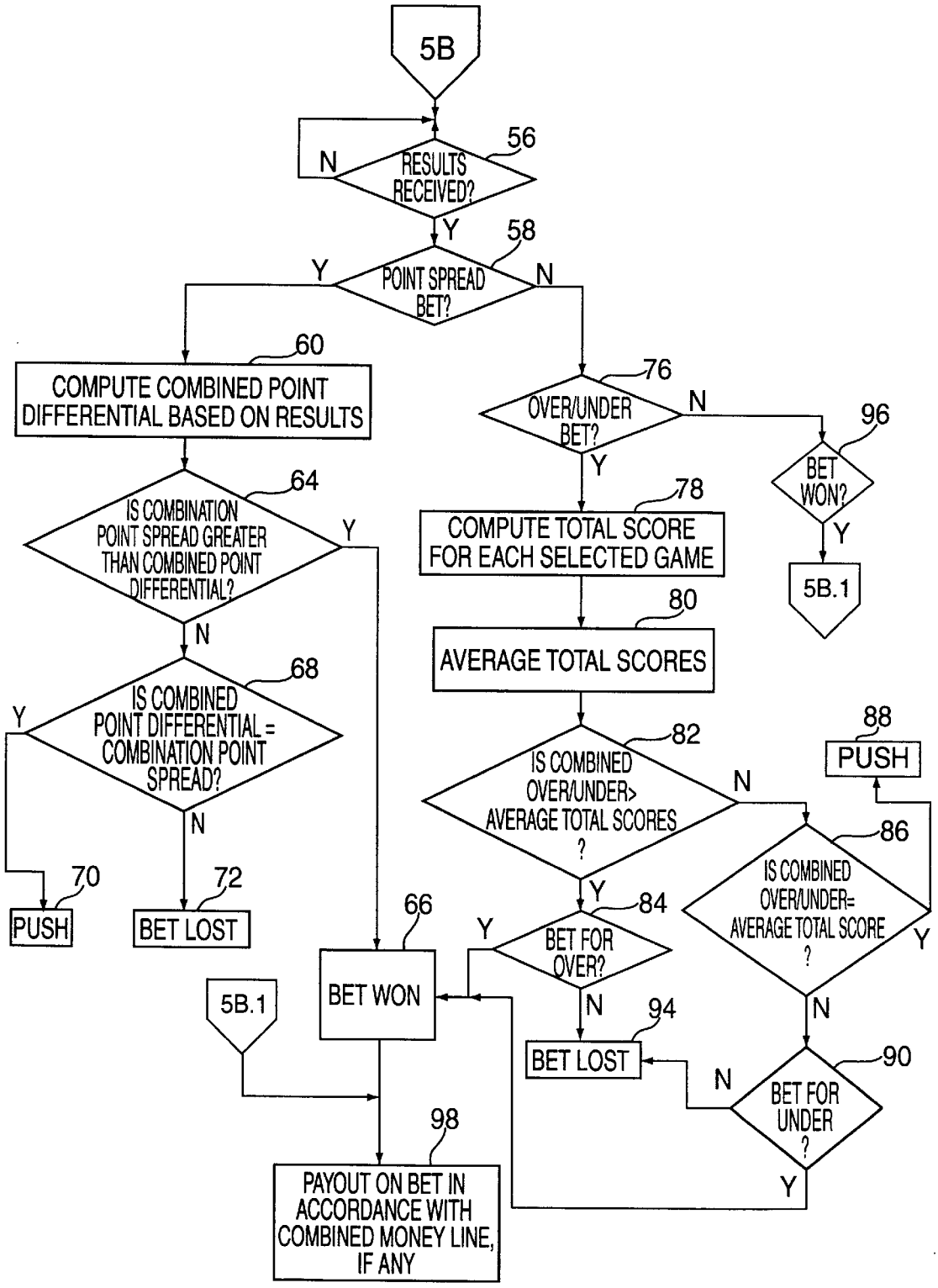

A computerized system for implementing the present invention is shown in FIG. 4. A licensed sports booking institution 8 has a computer network including a server 10 and a number of terminals 12. The server 10 stores the lines 14 for a number of different sports and transmits these lines to the terminals 12. Bettors can view the lines 14 on the terminals 12 and select a number of games and teams to place a combination bet. The selected games and teams are transmitted from the terminals 12 to the server 10 and stored in a database 16 of bettors and combination bets. The results of the sporting events are input into the server 10 through a terminal 17. The server 10 contains a combination bet processing program 18 which functions in accordance with the process described below with reference to FIGS. 5A and 5B to process the combination bets and event results and determine which bets were successful.

The booking institution may be connected via conventional telecommunication link to a remote betting location 20 having its own locally connected terminals 22. Individual remote computers 24 may be connected directly to the server 10 through a conventional network such as a private on-line service or the Internet. In addition, interactive television receivers 26, such as WebTV or other technologies known to those of skill in the art, may be connected to the server 10 such that the bettor can receive television signals to watch the game while communicating with the server 10.

The operation of one embodiment of the combination bet processing program 18 is now described with reference to the flow chart in FIGS. 5A–5B. For each bet received at the server and stored in the bets database, the program retrieves the bet, step 30, which contains a number of selected teams or games. The lines for each selected team or game is retrieved, from the full line, step 32, until lines for all selected teams or games have been retrieved, step 34. If the bet is for a combination point spread, step 36, the point spread for each selected team is retrieved from the line, step 38, and the retrieved point spreads are summed into a combined point spread, step 40. The combined point spread is stored in the bets database, step 42, as the bettor's combination bet.

If the bet is a combination over/under bet, step 44, the over/under numbers for each selected game is retrieved from the lines, step 46, and these numbers are averaged into a combined over/under bet, step 48, in accordance with the procedure described above. The combined over/under bet is stored as the bettor's combination bet, step 50.

If the lines for the selected games or teams have money lines, step 52, the program computes and stores a combination money line in accordance with the procedures described above, step 54. A combination money line may be used with or without combination point spreads and over/under bets, as explained above.

When results of the selected games are received, step 56, the program determines whether the combination bet is successful. If the bet is a combination point spread bet, step 58, a combined point differential is computed using the equation set forth above, step 60, by totaling the points scored by the non-selected teams and subtracted that total with the total points scored by all the selected teams. Alternatively, the point differential for each selected game is computed by reference to the score in the game in accordance with standard betting practice and these point differentials are summed into a combined point differential. If the combined point differential covers the combination point spread, step 64, the program declares the bet won, step 66. If the combination point spread equals the combined point differential, step 68, the bet is declared a push, step 70. Otherwise, the bet is lost, step 72.

If the bet is a combination over/under bet, step 76, the total score for each selected game is computed, step 78, and these total scores are averaged into a combined total score, step 80. If the combination over/under bet is greater than the combined total score, step 82, and if the combination bet was for over, step 84, the program declares the bet won, step 66. If the combined total score equals the combination over/under, step 86, the bet is a push, step 88. If the bet was for under, step 90 and the combination over/under is less than the total score, the bet is won, step 66. The bet is declared lost, step 94, when the results are opposite to the choice of over or under.

If the combination bet is won, step 96, the program computes the payout using the combined money line, if any, step 98. The winnings may be transmitted electronically to a bettor's account or credited on a credit card, in accordance with conventional electronic data interchange techniques.

As a variation on this procedure, the program can compute interim results based on input of results from some but not all the games in the combination bet. The program would compute, based upon the combination point spread or over/under, a new combination point spread or over/under for the remaining games which is necessary for winning the bet. For example, given the combination bet of Dallas, Atlanta, Buffalo and Chicago set forth above, with a combination point spread of +6½, if the program receives results from the Dallas and Atlanta games such as Dallas 21 Pittsburgh 20 and New England 28 Atlanta 20, the program computes an interim point differential of +7 (−1++8). This interim point differential is then compared to the combination point spread of +6½, and the program computes a new combination point spread for the remaining games of −½. These interim results would then be communicated to the bettor so that the bettor is aware of the condition necessary for winning the combination bet.

As a further variation, the bettor may be permitted to place combination bets on interim results of games, such as scores after one quarter or period, at half time, or at other regular intervals in the games. The interim point spreads may be combined with interim point spreads from other points in the same or from other games into a combination bet.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A method for accepting wagers on multiple contests comprising:

presenting a plurality of contests upon which wagers may be made, each contest having associated therewith at least one number which determines based upon an outcome of the contest whether a wage made on the contest is won, wherein the contests are sporting events each involving two teams, the outcomes for which being determined by points scored by each of the teams;

allowing a bettor to select two or more of the plurality of contests upon which to place a wager;

computing a first combined number for the selected contests based on the numbers associated with the selected contests;

when the outcomes of the selected contests are determined, computing a second combined number based on the outcomes of the selected contests; and comparing the first combined number to the second combined number to determine whether the bettor wins the wager.

2. The method of claim 1 wherein the at least one number associated with each sporting event comprises a point spread for a fmal or partial score of the event, the method comprising allowing a bettor to select one of the teams involved in each of the selected contests.

3. The method of claim 2 wherein the step of computing a first combined number comprises summing the point spreads associated with each of the selected teams.

4. The method of claim 3 wherein the step of computing a second combined number comprises computed a combined point differential based on the outcomes of the selected contests.

5. The method of claim 4 wherein the step of computing the combined point differential comprises summing the points scored by teams participating in the selected contests but not selected by the bettor into a first sum, summing the points scored by the selected teams into a second sum, and subtracting the second sum from the first sum.

6. The method of claim 4 wherein the step of computing the combined point differential comprises summing point differentials associated with each of the selected teams as determined from the final or partial scores of the sporting events.

7. The method of claim 4 wherein the step of comparing comprises determining whether the first combined number is greater than the second combined number.

8. The method of claim 1 wherein the at least one number comprises an over/under number.

9. The method of claim 8 comprising allowing a bettor to choose over or under, wherein the step of computing a first combined number comprises summing the over/under numbers for the selected sporting events, wherein the step of computing a second combined number comprises summing the total points scored in the selected contests, and wherein the step of comparing comprises determining whether the second combined number is greater than or less than the first combined number, respectively, depending upon the bettor's choice.

10. The method of claim 6 comprising allowing a bettor to choose over or under, wherein the step of computing a first combined number comprises averaging the over/under numbers for the selected sporting events, wherein the step of computing a second combined number comprises averaging the total points scored in the selected contests, and wherein the step of comparing comprises determining whether the first combined number is over or under the second combined number, depending upon the bettor's choice.

11. A method for accepting wagers on multiple sporting events, each sporting event involving two teams, each team having associated therewith a point spread used in determining whether a wager made on the team is won, the method comprising:

allowing a bettor to select a team from each of two or more events upon which to place a wager;

summing the point spreads associated with the selected teams to define a combined point spread wager;

after the results of the sporting events involving the selected teams are determined, computing a combined point differential associated with the selected teams as determined from the results of the sporting events; and if the combined point differential covers the resulting combined point spread wager, declaring the bettor a winner.

12. The method of claim 11 wherein the point spreads associated with each of the two teams in each sporting event are equal.

13. The method of claim 11 wherein the point spreads associated with each of the two teams in at least one of the sporting events are not equal.

14. The method of claim 11 comprising adjusting a payout for the wager placed by the bettor depending upon the number of teams selected by the bettor.

15. The method of claim 11 wherein each of the selected teams has associated therewith a money line representing a payout for wagers on that team, the method comprising computing a combined money line for the selected teams.

16. The method of claim 15 wherein the step of computing the combined money line comprises averaging the money lines associated with each of the selected teams.

17. The method of claim 15 comprising adjusting the payout for the wager based on the combined money line.

18. The method of claim 11 wherein the sporting events are football games.

19. The method of claim 11 wherein the sporting events are basketball games.

20. The method of claim 11 wherein the sporting events are hockey games.

21. The method of claim 11 wherein the sporting events are soccer games.

22. The method of claim 11 wherein the sporting events are baseball games.

23. A method for wagering on multiple sporting events, each sporting event involving two teams, each team having associated therewith a point spread used in determining whether a wager made on the team is won, the method comprising:

selecting a team from each of two or more events upon which to place a wager;

summing the point spreads associated with the selected teams to define a combined point spread wager;

wagering on the combined point spread; and winning the wager if a combination of point differentials associated with the selected teams as determined from the results of the sporting events covers the combined point spread.

24. A method for accepting wagers on multiple sporting events, each sporting event involving two teams, each team having associated therewith a money line representing a payout for wagers on that team, the method comprising:

allowing a bettor to select a team from each of two or more events upon which to place a wager;

computing a combined money line for the selected teams based on the money lines associated with each selected team; and if the selected teams cover the wager, paying out on the wager based upon the combined money line.

25. The method of claim 24 wherein the step of computing the combined money line comprises averaging the money lines associated with the selected teams.

* * * * *